US007337878B1

(12) United States Patent
Lockhart

(10) Patent No.: US 7,337,878 B1
(45) Date of Patent: Mar. 4, 2008

(54) EMERGENCY LADDER SYSTEM

(76) Inventor: Walter Lockhart, 844 St. Nicholas Ave., New York, NY (US) 10031

( * ) Notice: Subject to any disclaimer, the term of this patent is extended or adjusted under 35 U.S.C. 154(b) by 0 days.

(21) Appl. No.: 10/665,681

(22) Filed: Sep. 18, 2003

Related U.S. Application Data

(60) Provisional application No. 60/411,581, filed on Sep. 18, 2002.

(51) Int. Cl.
*A62B 1/06* (2006.01)

(52) U.S. Cl. ..... 182/70; 182/86; 182/18

(58) Field of Classification Search ..... 182/70, 182/18, 86, 62.5, 208
See application file for complete search history.

(56) References Cited

U.S. PATENT DOCUMENTS 552,180 A * 12/1895 Hardouin ..... 182/68.1
3,825,096 A * 7/1974 Mendes ..... 182/86
3,887,033 A * 6/1975 Breinig ..... 182/78
3,999,627 A 12/1976 Naka
4,010,822 A * 3/1977 Banner ..... 182/18
4,109,760 A * 8/1978 Marra ..... 182/48
4,792,015 A 12/1988 Brudi
5,411,111 A * 5/1995 Greve ..... 182/17
5,605,203 A 2/1997 Chang
5,785,147 A * 7/1998 Lee ..... 182/70
5,825,280 A * 10/1998 Merendini et al. ..... 340/326
5,842,539 A * 12/1998 Hough ..... 182/70
5,875,870 A * 3/1999 Lee ..... 182/70
5,908,082 A * 6/1999 Turner et al. ..... 182/18
6,129,178 A * 10/2000 Shupp, Jr. ..... 182/76
6,135,239 A * 10/2000 Martin et al. ..... 182/70

FOREIGN PATENT DOCUMENTS

GB 2222848 * 3/1990 ..... 182/70 X

* cited by examiner

*Primary Examiner*—Alvin Chin-Shue

(57) ABSTRACT

An emergency ladder system for providing an exit from non-ground level floors of a building in the event of an emergency such as a fire includes an alarm system having fire detectors positioned in a building. The alarm system is operationally coupled to a ladder positioned in a compartment, typically underground. Upon detection of a fire in the building, a door covering the compartment is automatically opened, an audible alarm sounds, and the ladder is extended to reach an opening in an upper floor of the building to provide an escape route from the building.

16 Claims, 3 Drawing Sheets

EMERGENCY LADDER SYSTEM

CROSS REFERENCE TO RELATED APPLICATION

This application claims the benefit of U.S. Provisional Application No. 60/411,581, filed Sep. 18, 2002.

BACKGROUND OF THE INVENTION

1. Field of the Invention

The present invention relates to fire escape systems and more particularly pertains to a new emergency ladder system for providing an exit from non-ground level floors of a building in the event of an emergency such as a fire.

2. Description of the Prior Art

The use of fire escape systems is known in the prior art. U.S. Pat. No. 3,999,627 issued to Naka describes system that extends a telescopic pipe sections and rungs down from a building. Another type of ladder system is U.S. Pat. No. 4,792,015 issued to Brudi disclosing another system that is extended from a building, particularly by gravity when a solenoid is activated. U.S. Pat. No. 5,605,203 issued to Chang discloses yet another system that extends a ladder structure from a building.

While these devices fulfill their respective, particular objectives and requirements, the need remains for a system that is spaced from the building when inactive and extends towards the building when activated to lessen the chance that fire will inhibit or damage the system.

SUMMARY OF THE INVENTION

The present invention meets the needs presented above by providing a ladder structure stored in spaced relationship to a building. The ladder is extended towards the building from a distance such that damage to the system by a fire in the building is inhibited. The ladders are pre-positioned to extend to particular openings or windows to prevent delay by having to align or adjust the ladders during extension.

An object of the present invention is to provide a new emergency ladder system that extends automatically towards a building upon detection of an emergency condition within the building.

Another object of the present invention is to provide a new emergency ladder system that is pre-positioned and aligned to permit expedited extension to a particular opening into the building.

To this end, the present invention generally comprises an alarm system having fire detectors positioned in a building. The alarm system is operationally coupled to a ladder positioned in a compartment, typically underground. Upon detection of a fire in the building, a door covering the compartment is automatically opened, an audible alarm sounds, and the ladder is extended to reach an opening in an upper floor of the building to provide an escape route from the building.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF A PREFERRED EMBODIMENT

Figure 1:
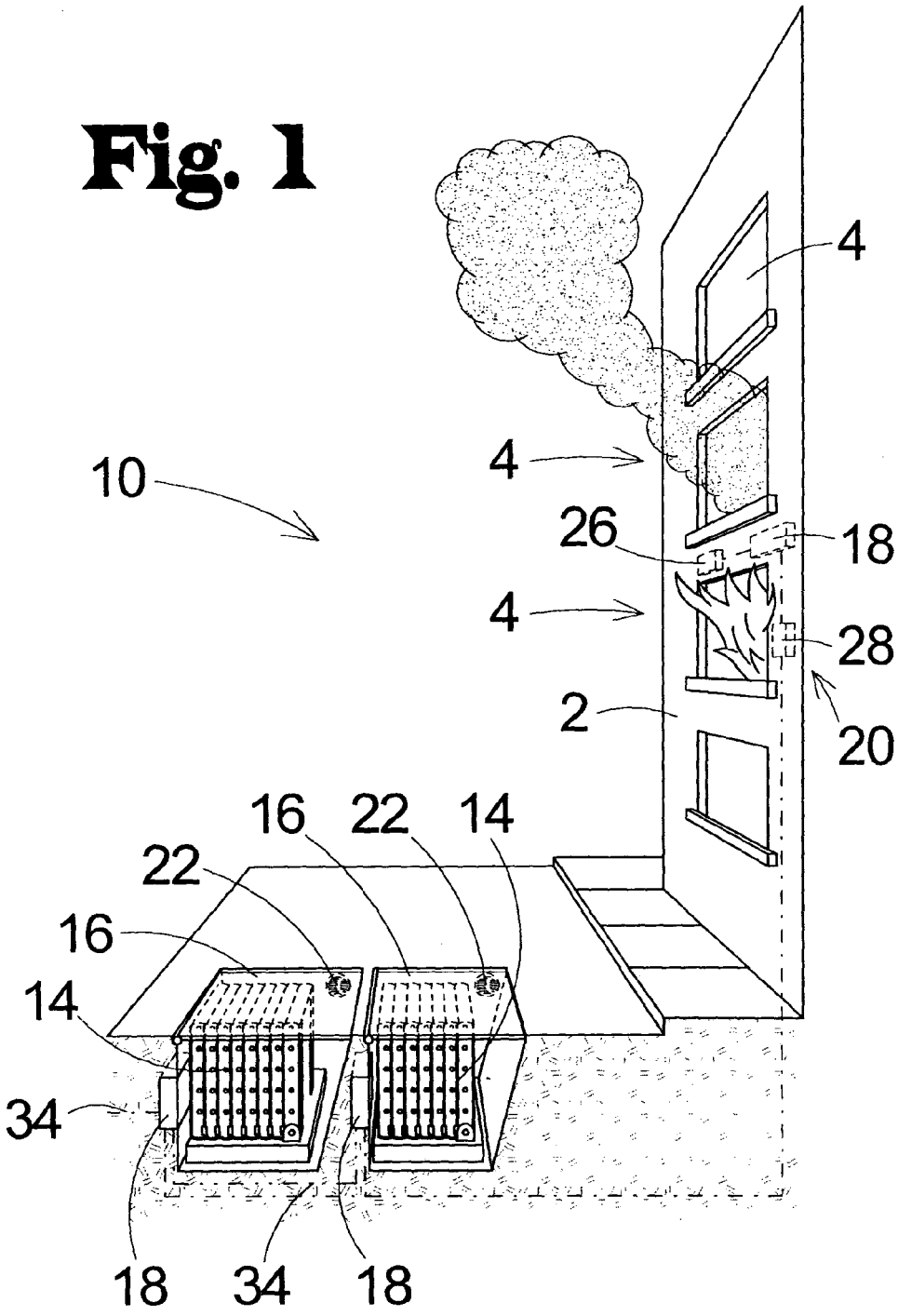
FIG. 1 is a perspective view of a new emergency ladder system according to the present invention.
Figure 2:
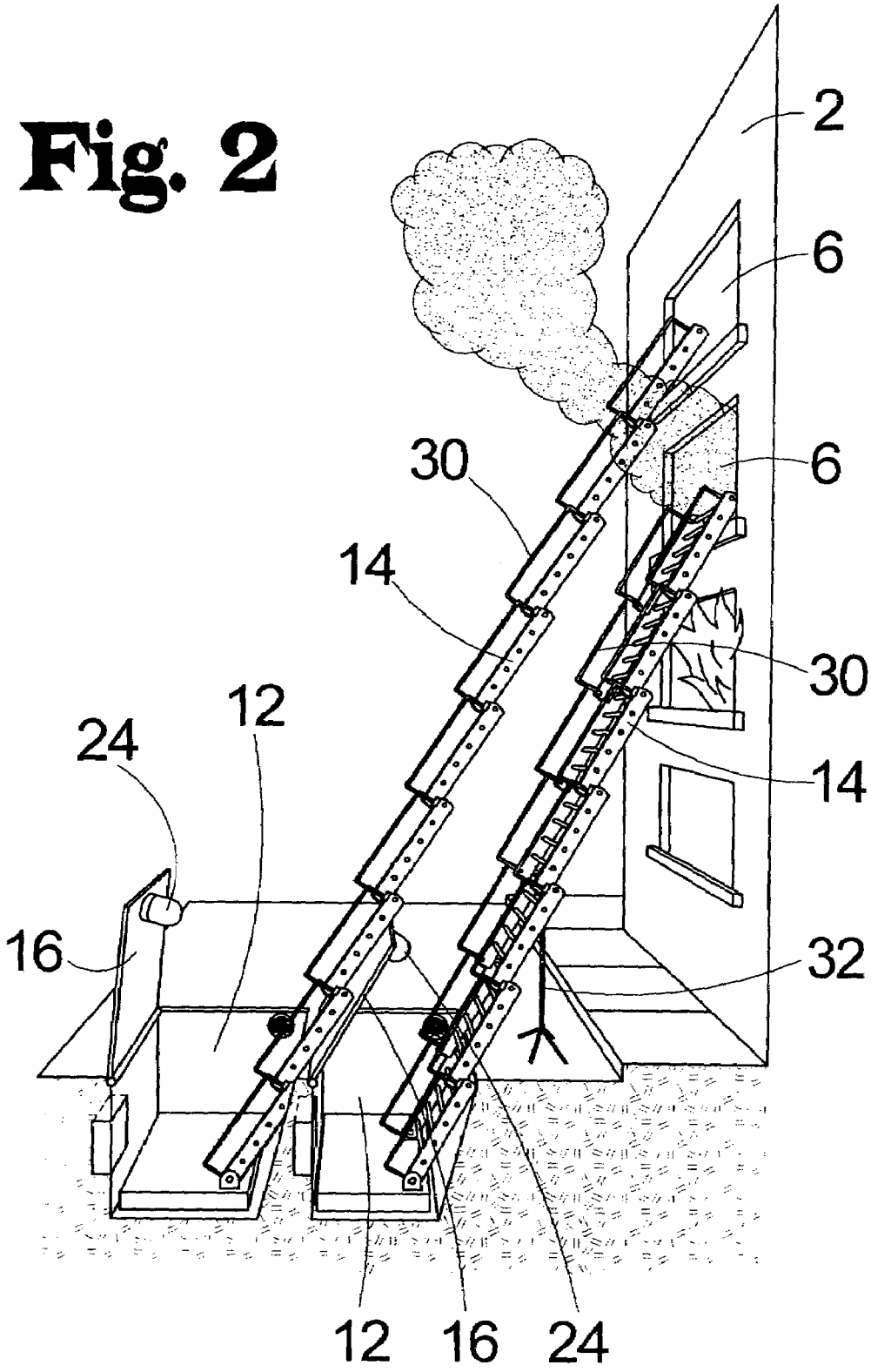
FIG. 2 is a perspective view of the present invention in a deployed state.
Figure 3:
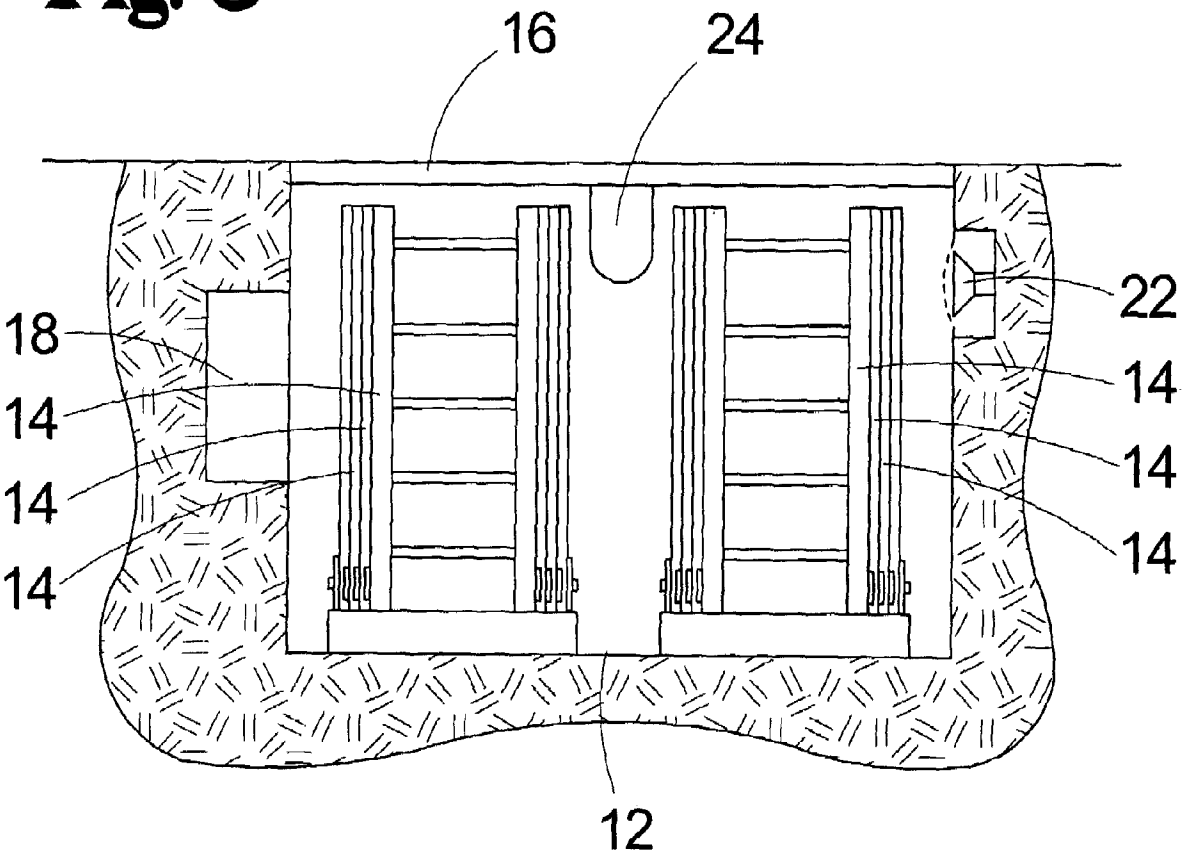
FIG. 3 is a front view of an alternate configuration of the present invention.

With reference now to the drawings, and in particular to FIGS. 1 through 3 thereof, a new emergency ladder system embodying the principles and concepts of the present invention will be described.

As best illustrated in FIGS. 1 through 3, the system 10 of the invention generally comprises a building 2 having multiple floors 4. A compartment 12 is positioned adjacent to the building 2. An extendable ladder 14 is positioned inside the compartment 12. A door 16 covers the compartment 14. An alarm assembly 18 is provided and includes a sensor 20 inside the building 2 for detecting a fire. The alarm assembly 18 is operationally coupled to the door 16 and the ladder 14 to open the door 16 and extend the ladder 14 when fire is detected by the sensor 20.

An alarm bell 22 is operationally coupled to the alarm assembly 18 to give an audio warning when the door 16 is open. Typically, the alarm bell 22 is positioned in the compartment 12. The door 16 includes a caution light 24 that illuminates when the door 16 is opened to expose the compartment 12. Thus, the bell 22 and the light 24 serve to provide warning to nearby persons that a hazardous condition exists, i.e. an opening in a ground surface from which a ladder does or will emanate.

The alarm assembly 18 includes at least one of a smoke sensor 26 and a heat sensor 28. However, the alarm assembly 18 should include both a smoke sensor 26 and a heat sensor 28 for activating the system upon either detection of smoke in excess of a pre-determined level or detection of heat above a pre-determined level.

In an embodiment, the ladder 14 is positioned to extend towards an opening 6 into a floor level of the building 2 above a first floor level. In consideration of the structural variances between different buildings, it is intended that the ladder may be oriented to extend to any desired position relative to the building that is sufficiently distant from an outside ground level that a person would likely be injured from a fall.

In an embodiment, a hand rail 30 is coupled to the ladder 14 to assist persons in using the ladder 14.

For a ladder 14 that is designed to extend a great distance, a support pole 32 is extendably coupled to the ladder 14 such that the support pole 32 extends out from the ladder 14 to brace the ladder 14 when the ladder 14 is in an extended position. This facilitates positioning of the ladder at an angle that would be similar to steps found in common stairwells to facilitate quick and easy egress from the building. The support pole 32 may be stored in a folded position or may be a unitary piece that pivots between a stored position and a use position. The support pole may be deployed responsive to gravity as the ladder 14 extends.

The alarm assembly 18 and the ladder 14 are both powered by a direct connection to a power line 34 separate from a power line for the building 2 to prevent failure of the ladder 14 and alarm assembly 18 in the event that power is cut to the building 2.

Multiple ladders and compartments may be employed as desired. Each ladder 14 is positioned to extend from a respective compartment 12 to a unique opening into the building 2 to provide multiple escape routes from the building. Similarly, multiple ladders 14 may be positioned within a single compartment 12'. Each ladder is positioned to extend to a unique opening into the building to provide multiple escape routes from the building.

In use, the alarm system detects a fire within the building and sets off the audio alarm and opens the compartment door. The ladder or ladders are extended to reach openings in the building to provide an additional escape route from the building that extends away from the building as opposed to conventional fire escape structures that are positioned immediately adjacent the building from top to bottom.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system comprising:

a building having multiple floors;

a compartment adjacent to said building;

an extendable ladder positioned inside said compartment;

a door covering said compartment;

an alarm assembly including a sensor inside said building for detecting a fire; and said alarm system being operationally coupled to said door and said ladder to open said door and extend said ladder when fire is detected by said sensor;

wherein said extendable ladder is extendable in an upward direction from the compartment toward the building.

2. The system of claim 1 further comprising:

an alarm bell operationally coupled to said alarm assembly to give an audio warning when said door is open.

3. The system of claim 2, wherein said alarm bell is positioned in said compartment.

4. The system of claim 1 wherein said door includes a caution light that illuminates when said door is opened to expose the compartment.

5. The system of claim 1 wherein said alarm assembly includes at least one of a smoke sensor and a heat sensor.

6. The system of claim 1 wherein said alarm assembly includes both a smoke sensor and a heat sensor for activating said system upon one of said smoke sensor detecting smoke in excess of a pre-determined level and said heat sensor detecting heat above a pre-determined level.

7. The system of claim 1 wherein said ladder is positioned to extend towards an opening into a floor level of said building above a first floor level.

8. The system of claim 1, further comprising:

a hand rail coupled to said ladder.

9. The system of claim 1, further comprising:

a support pole extendably coupled to said ladder such that said support pole extends out from said ladder to brace said ladder when said ladder is in an extended position.

10. The system of claim 1 wherein said alarm assembly and said ladder are powered by a direct connection to a power line separate from a power line for said building to prevent failure of said ladder and alarm assembly when power is cut to said building.

11. The system of claim 1 comprising multiple ladders and multiple compartments, each ladder being positioned to extend from a respective one of said multiple compartments to a unique opening into said building to provide multiple escape routes from said building.

12. The system of claim 1 wherein multiple ladders are positioned within a single said compartment, each ladder being positioned to extend to a unique opening into said building to provide multiple escape routes from said building.

13. The system of claim 1 wherein said door opens upwardly with respect to said compartment.

14. The system of claim 1 wherein said building has an opening permitting egress from said building, and said compartment is positioned at a relatively lower vertical level with respect to a vertical height of said opening in said building.

15. The system of claim 1 wherein said compartment is spaced from a side of said building.

16. The system of claim 1 wherein said compartment is embedded in a ground surface adjacent to said building.

* * * * *